US006643936B2

(12) United States Patent
Carlson et al.

(10) Patent No.: US 6,643,936 B2
(45) Date of Patent: Nov. 11, 2003

(54) HAND-HELD ROTARY CUTTER

(75) Inventors: Christopher Robert Carlson, Wausau, WI (US); William J. Schulz, Mosinee, WI (US)

(73) Assignee: Alterra Holdings Corporation, Tigard, OR (US)

( * ) Notice: Subject to any disclaimer, the term of this patent is extended or adjusted under 35 U.S.C. 154(b) by 0 days.

(21) Appl. No.: 10/052,215

(22) Filed: Jan. 17, 2002

(65) Prior Publication Data

US 2003/0131483 A1 Jul. 17, 2003

(51) Int. Cl.[7] ..... B26B 1/08; B26B 29/02
(52) U.S. Cl. ..... 30/162; 30/292; 30/319
(58) Field of Search ..... 30/162, 263, 292, 30/307, 312, 319, 320; D8/98, 99

(56) References Cited

U.S. PATENT DOCUMENTS

| | | | | |
|---|---|---|---|---|
| 1,075,050 A | | 10/1913 | Mihills | |
| 1,284,658 A | | 11/1918 | Gullborg | |
| 1,487,226 A | | 3/1924 | Frahm | |
| 2,526,154 A | | 10/1950 | Parks | 17/29 |
| 2,568,353 A | | 9/1951 | Miseta, Jr. | 30/122 |
| 3,139,124 A | | 6/1964 | Hoff | 143/6 |
| D232,413 S | | 8/1974 | Steiner | D7/106 |
| 3,924,328 A | | 12/1975 | Mould | 30/307 |
| D260,358 S | | 8/1981 | Wilson et al. | D8/98 |
| 4,432,137 A | | 2/1984 | Okada | 30/292 |
| D288,522 S | | 3/1987 | Salem | D8/98 |
| D298,409 S | | 11/1988 | Sugiyama | D8/98 |
| 4,809,437 A | | 3/1989 | Saliaris | 30/319 |
| 5,101,564 A | | 4/1992 | Melter | 30/319 |
| 5,144,749 A | | 9/1992 | Chen | 30/319 |
| 5,299,355 A | * | 4/1994 | Boda et al. | 30/292 |
| D346,542 S | | 5/1994 | Birkholz | D8/98 |
| 5,355,588 A | | 10/1994 | Brandenburg, Jr. et al. | 30/319 |
| D379,193 S | | 5/1997 | Cornell | D18/34 |
| 5,711,077 A | * | 1/1998 | Schulz et al. | 30/319 |
| D412,274 S | * | 7/1999 | Okada | D8/98 |
| 6,189,218 B1 | * | 2/2001 | Okada | 30/162 |

FOREIGN PATENT DOCUMENTS

DE 32 32 161 C1 * 3/1984

* cited by examiner

*Primary Examiner*—Hwei-Siu Payer
(74) *Attorney, Agent, or Firm*—Foley & Lardner

(57) ABSTRACT

A hand held rotary cutter comprising a first handle including a head at one end thereof for receiving a blade and a second handle pivotally connected to the first handle. The second handle includes a rotating member at one end thereof. The rotating member rotates into and out of alignment with the head of the first handle to guard the blade. A spring biases the first and second handles to an open position, and a latch is mounted on one of the first and second handles and movable between an unlocked position and a locked position. The latch is engageable with a member on the other of the first and second handles. When the latch is in the unlocked position, the first handle and the second handle are fixed in position relative to each other.

20 Claims, 6 Drawing Sheets

HAND-HELD ROTARY CUTTER

FIELD OF THE INVENTION

The present invention is directed to cutting tools. More particularly, the present invention is related to a hand-held rotary cutting tool that is simple to use and incorporates an easily replaceable cutting edge.

BACKGROUND OF THE INVENTION

Hand-held rotary cutting tools are conventionally known. Such rotary cutters are of particular utility for cutting sheet material such as cloth and wallpaper. Rotary cutters often comprise an elongated handle with a circular cutting blade rotatably fastened to one end. The user grasps the handle and rolls the circular cutting blade along the object to be cut, while placing downward and forward pressure on the cutting wheel. Guard mechanisms to cover or otherwise limit access to the blade when the rotary cutter is not in use are also conventionally known.

Many prior art hand-held rotary cutters tend to have a number of disadvantages. For example, some hand-held rotary cutting tools tend to be uncomfortable and difficult to guide accurately when exerting sufficient downward and forward force to effect cutting. Additionally, several conventional cutting tools include guard mechanisms which are cumbersome in how the blade is to be exposed and retracted. Other conventional cutting tools are not equally capable of use with either a right or a left hand. A number of portable rotary cutters do not include any mechanism for fixing the handles in either a closed position or an open position. Furthermore, a number of rotary cutters include several components which make the cutter relatively expensive to manufacture.

SUMMARY OF THE INVENTION

It is therefore an object of the invention to provide an improved rotary cutting tool that can be fixed in either an open position or a closed position.

It is another object of the invention to provide an improved rotary cutting tool that includes a simple mechanism for removing and replacing a cutting edge.

It is yet another object of the present invention to provide an improved rotary cutting tool that is inexpensive to manufacture.

It is still another object of the invention to provide an improved rotary cutting tool that can be more easily used by both right-handed and left-handed individuals.

It is another object of the invention to provide an improved rotary cutting tool that increases the exposure of the blade during cutting while maintaining an adequate level of safety.

It is finally another object of the present invention to provide an improved rotary cutting tool that permits a blade to be replaced without the use of additional tools.

In accordance with the above objects, a rotary cutting tool comprises a first handle including a head at one end thereof for receiving a blade, the head having a transverse member upon which a blade may be mounted. A second handle is pivotally connected to the first handle and includes a blade guard. The blade guard is capable of moving into and out of alignment with the head. A biasing member biases the first and second handles away from each other to an open position. A latch is mounted on the second handle and is movable between a first position and a locked position. The latch is engageable with a coupling member on the first handle.

BRIEF DESCRIPTION OF THE DRAWINGS

The foregoing advantages and features of the invention will become apparent upon reference to the following detailed description and the accompanying drawings, of which.

DETAILED DESCRIPTION OF THE INVENTION

Figure 1:
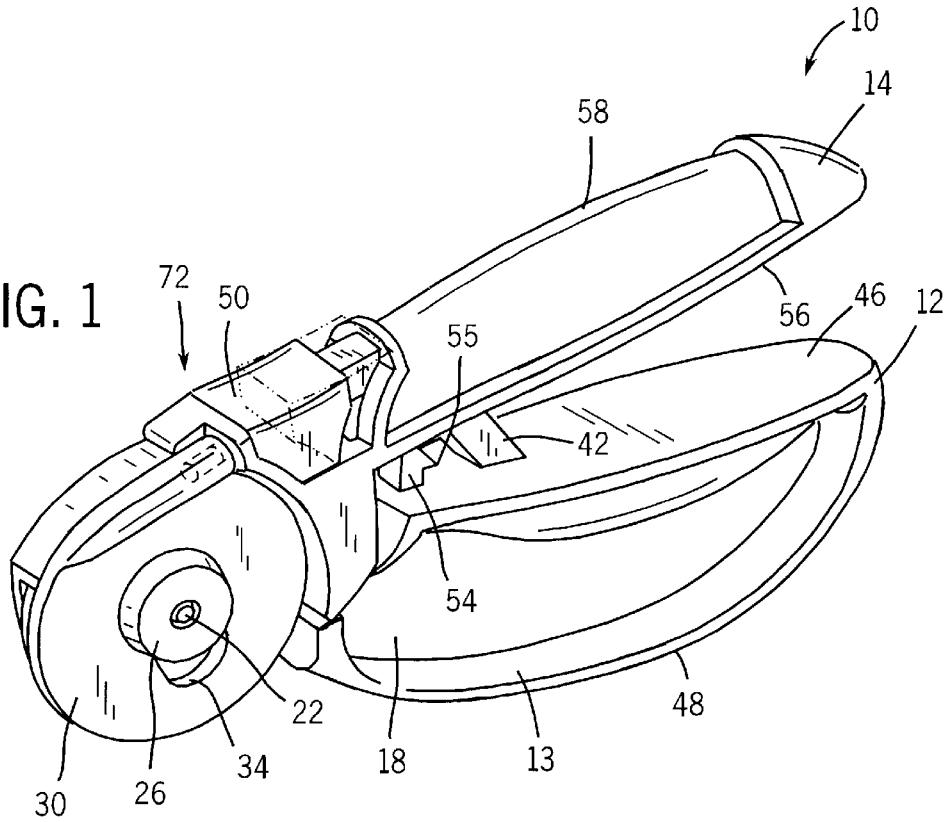
FIG. 1 is a perspective view of a rotary cutting device in an open position according to one embodiment of the invention.
Figure 2:
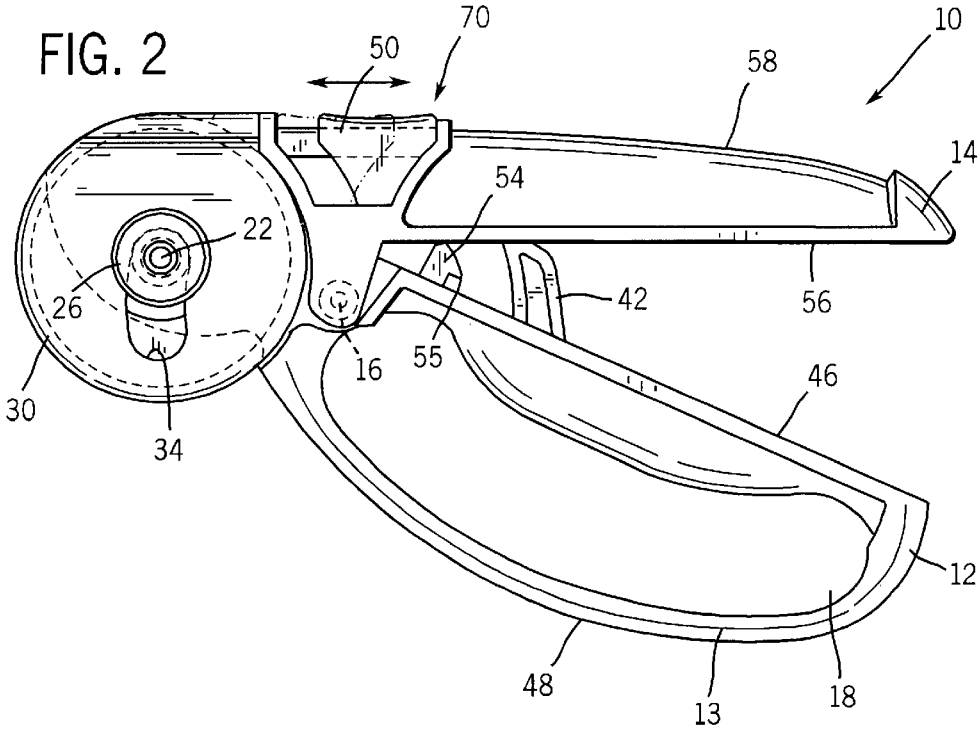
FIG. 2 is a side view of the rotary cutting device of FIG. 1 in the open position.

Referring to FIGS. 1, 2, 6 and 7, a rotary cutting device is shown generally at 10. The rotary cutting device 10 includes a first handle 12 and a second handle 14. The first handle 12 and the second handle 14 are pivotally connected to each other by a screw 16. Other types of connecting devices, such as pins, nails, rivets or similar mechanisms, can also be used as an adequate and functional pivoting device.

The first handle 12 includes a lower portion 13 which defines a slot 18 through which the user can place his or her hand. The slot 18 defined by the lower portion 13 of the first handle 12 provides the user with an additional amount of control of the cutting device 10. In a preferred embodiment of the invention, the first handle 12 and the second handle 14 are shaped such that a user can use the rotary cutting device 10 in a proficient matter whether he is right-handed or left-handed.

Figure 5:
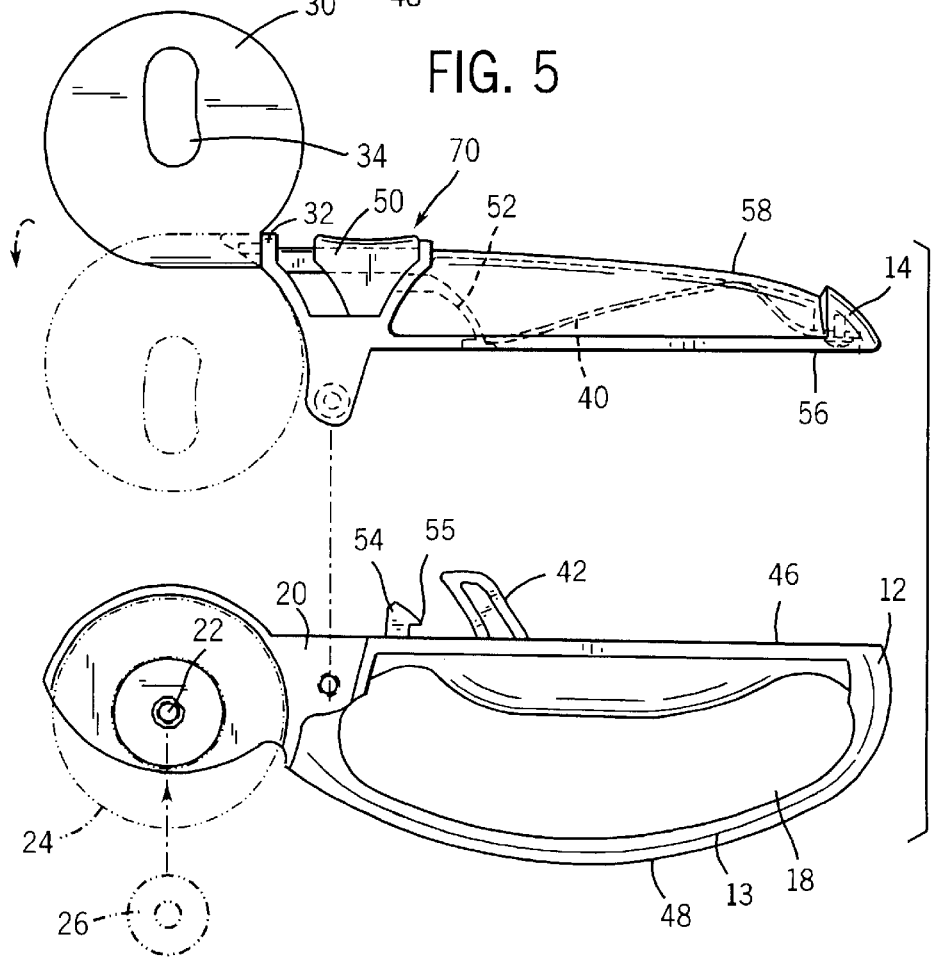
FIG. 5 is an exploded side view of the cutting device of FIG. 1.
Figure 12:
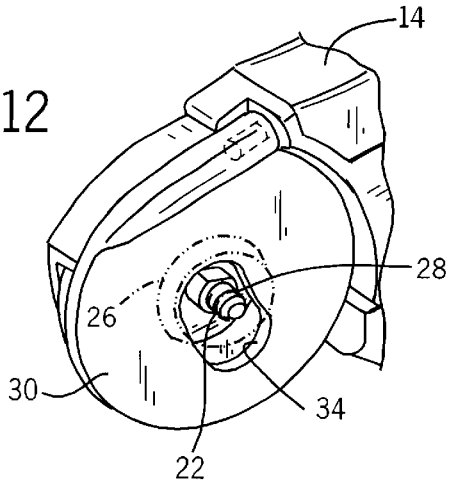
FIG. 12 is a segmented perspective view of the cutting device of FIG. 1 with the cap removed.

As shown in FIG. 5, the first handle 12 includes a head portion 20 at one end thereof. The head portion 20 includes a transverse member 22 which projects at about a ninety degree angle from the rest of the head portion 20. The transverse member 22 is sized such that a cutting blade 24 can be placed around the transverse member 22. The cutting blade 24 is secured on the transverse member 22 by a cap 26. In one preferred embodiment of the invention and as shown in FIG. 12, the cap 26 is secured to the transverse member 22 by a plurality of threads 28. It is possible, however, that any one of a variety of security mechanisms could be used to secure the cap 26 to the transverse member 22. For example, the cap 26 could be snap fit onto the transverse member 22.

Figure 4:
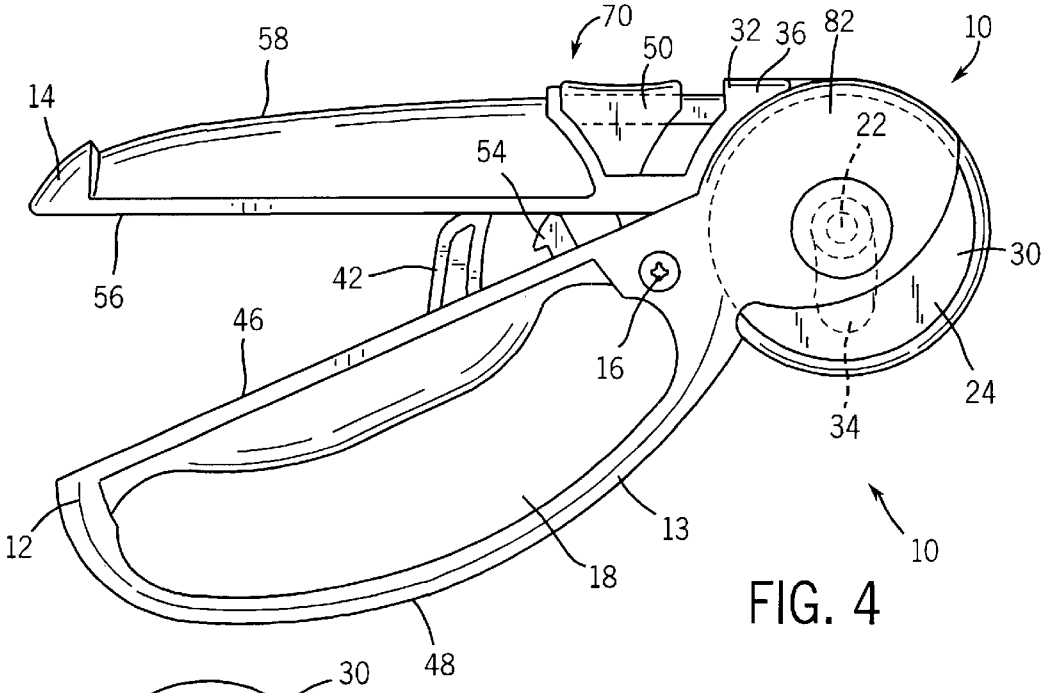
FIG. 4 is an opposite side view of the rotary cutting device of FIG. 1 with the blade guard in an open position.

As shown in FIGS. 4–5, the second handle 14 includes a blade guard 30 pivotally coupled thereto at a top portion 32. The blade guard 30 serves to protect the user from inadvertently injuring his or her hand on the cutting blade 24 when it is positioned within the cutting device 10. The blade guard 30 includes a slot 34 through which the transverse member 22 may be positioned. This permits the blade guard 30 to be placed in substantial alignment with the head portion 20. While the blade 24 is positioned on the transverse member 22, the transverse member 22 projects through the slot 34 and the cap 26 threadedly engages the transverse member 22. When mounted on the transverse member 22, the cap 26 is capable of impeding the movement of the blade guard 30 and the blade 24.

In one embodiment of the invention and as shown in FIG. 4, the second handle 14 also includes an abutment 36 adjacent to and substantially coplanar with the head portion 20 of the first handle 12. The abutment 36 serves to impede the motion of the first handle 12 relative to the second handle 14, effectively preventing the first handle 12 from moving too far away from the second handle 14.

The first handle 12 includes an inner side 46 and an outer side 48. Similarly, the second handle 14 includes an inner side 56 and an outer side 58. During the pivoting motion of the first handle 12 and the second handle 14 relative to each other, the inner side 46 of the first handle 12, in one embodiment of the invention, comes into contact with the inner side 56 of the second handle 14.

As shown in FIGS. 6–11, the inner side 56 of the second handle 14 includes leaf spring 40. The leaf spring 40 is engaged by a contact member 42 that is coupled to the inner side 46 of the first handle 12. In one preferred embodiment of the invention, the contact member 42 is formed as one piece with the first handle 12 and projects at an angle from the inner side 46 of the first handle 12 towards the inner side 56 of the second handle 14. In a most preferred embodiment of the invention, the leaf spring 40 and the contact number 42 are positioned such that they are in substantially constant engagement with each other. The engagement of the contact member 42 with the leaf spring 40 results in a biasing action, in which the first handle 12 is biased away from the second handle 14, biasing the rotary cutting device 10 towards an open position.

In one embodiment of the invention, the second handle 14 also includes a latch 50 that is movable between an unlocked position 70 and a locked position 72. This is shown clearly in FIG. 8. In a most preferred embodiment of the invention, the latch 50 is located on the outer side 58 of the second handle 14, although it is possible for the latch 50 to be located in a different position on the first handle 12 or the second handle 14. The latch 50 is coupled to a blocking member 52 that is positioned inside the inner side 56 of the second handle 14. The latch 50 and the blocking member 52 are arranged such that the first handle 12 and the second handle 14 can be locked in position relative to each other, fixing the rotary cutting device 10 in both an open position and a closed position.

Figure 6:
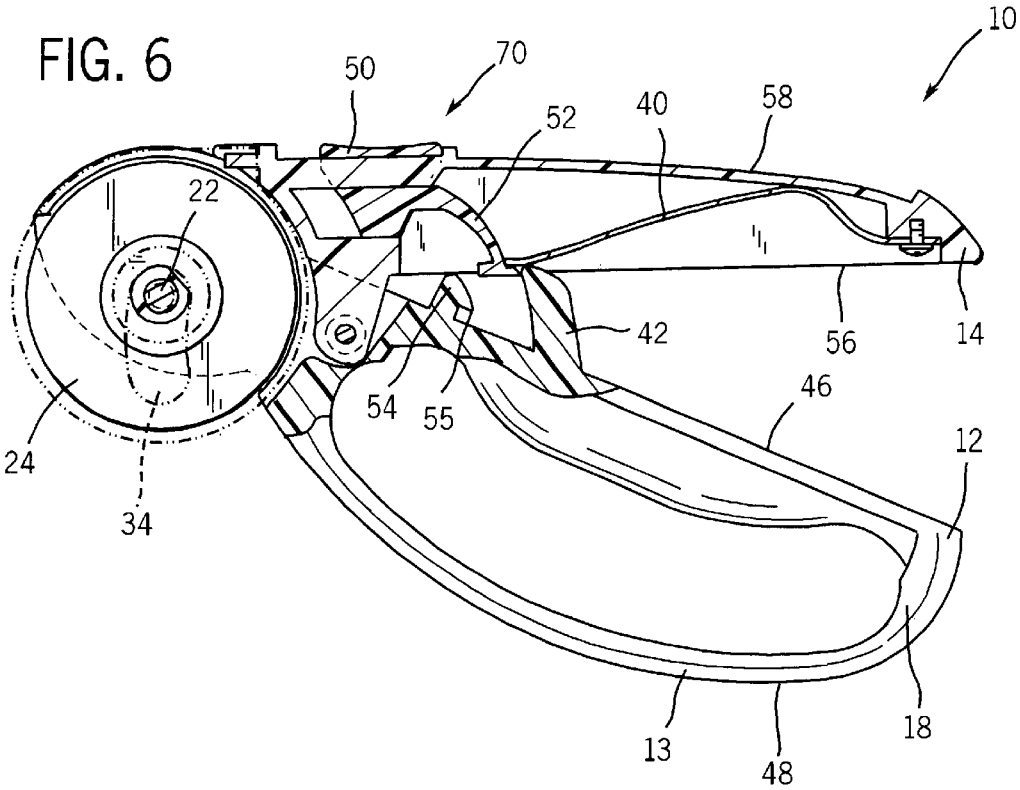
FIG. 6 is a sectional side view of the cutting device of FIG. 1 when in an open and unlatched position.
Figure 7:
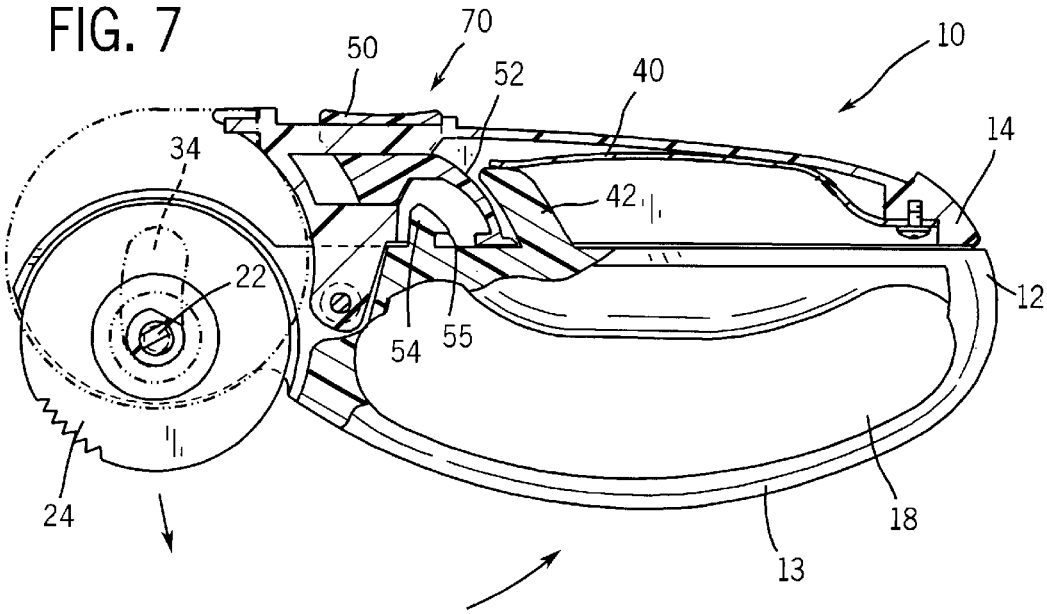
FIG. 7 is a sectional side view of the cutting device of FIG. 1 when in a closed and unlocked position.
Figure 8:
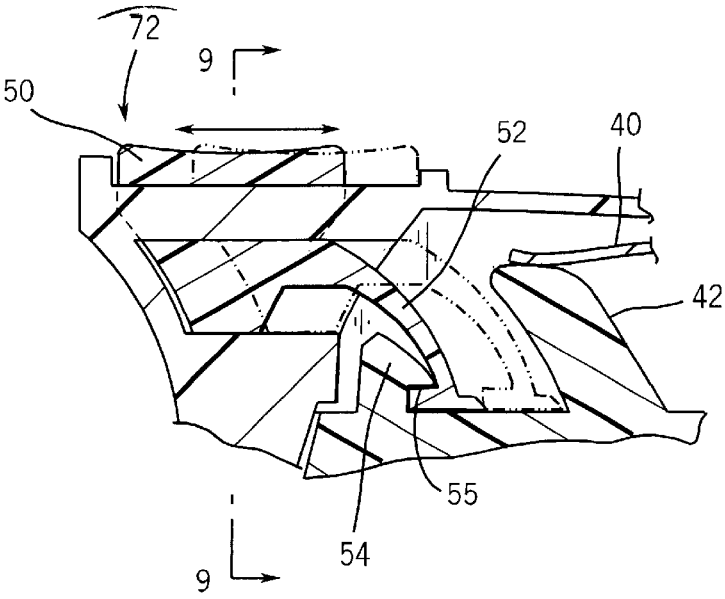
FIG. 8 is a magnified sectional view of the latching mechanism of the cutting device when in a locked position.
Figure 9:
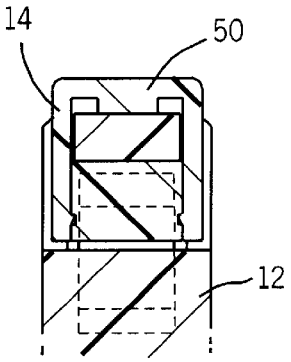
FIG. 9 is a sectional view of the latching mechanism taken along lines 9—9 of FIG. 8.
Figure 10:
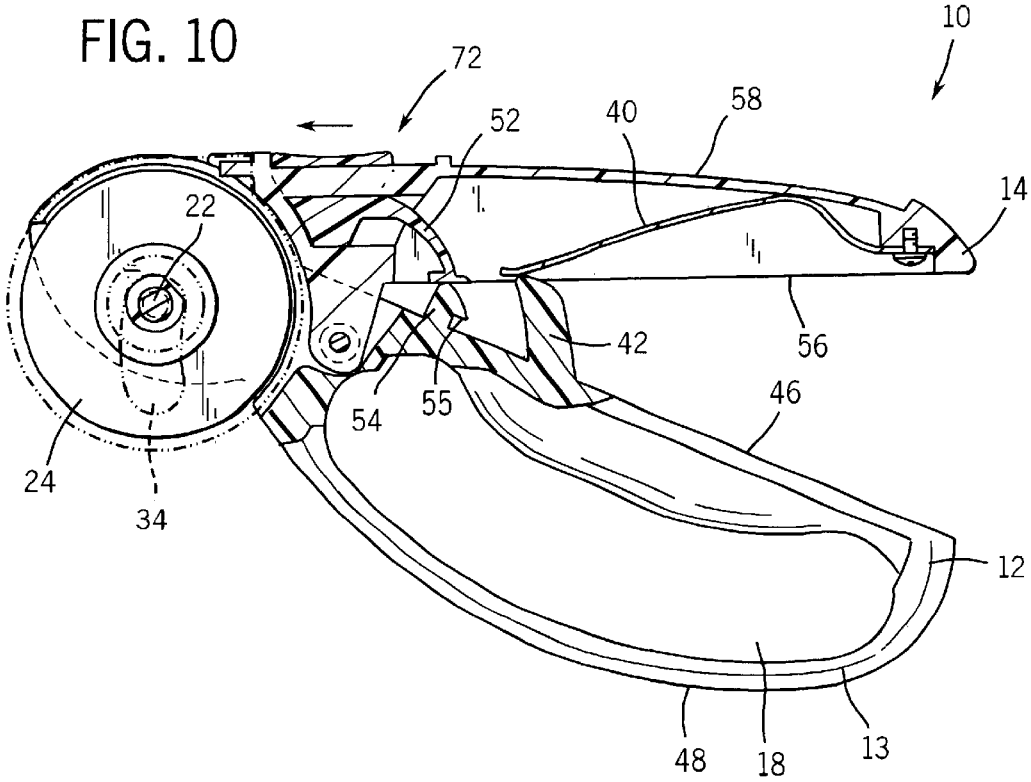
FIG. 10 is a sectional side view of the cutting device of FIG. 1 when in an open and locked position.
Figure 11:
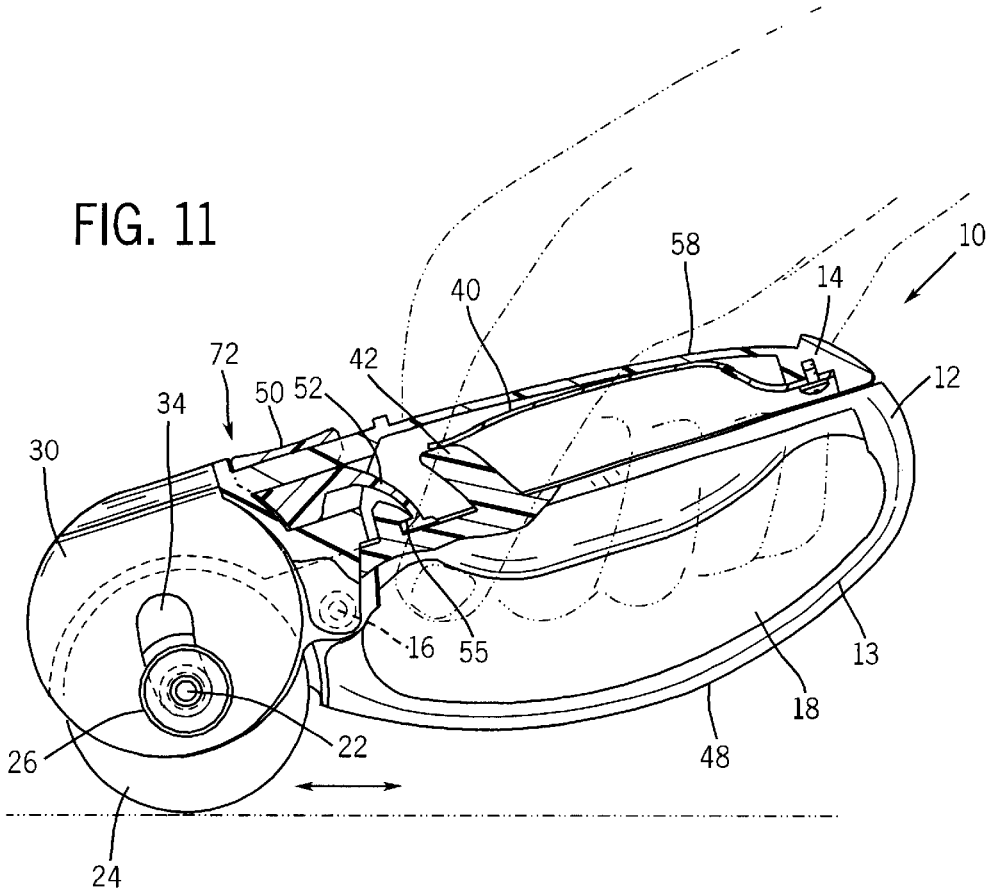
FIG. 11 is a sectional side view of the cutting device of FIG. 1 when in the closed and locked position.

When the latch 50 is in the unlocked position 70, shown for example in FIGS. 6 and 7, the first handle 12 and the second handle 14 are free to move towards each other and away from each other. When the latch 50 is in the unlocked position 70, the blocking member 52 does not contact a latching member 54 that is formed on the inner side 46 of the first handle 12. By maintaining the blocking member 52 in this position, the latching member 54, and the entire first handle 12 is capable of moving back and forth relative to the second handle 14.

When the latch 50 is moved to a locked position 72 the blocking member 52 is positioned to interfere with the latching member 54. This interference occurs regardless of whether or not the first handle 12 is in contact with the second handle 14. In the case where the rotary cutting device 10 is in an open position (i.e., the first handle 12 and the second handle 14 are separated), the latching member 54 comes into direct contact with and abuts the blocking member 52. This positioning prevents the first handle 12 from moving closer to the second handle 14. When the rotary cutting device 10 is in the closed position (i.e., the first handle 12 and the second handle 14 are in contact with each other), the latching member 54 is located partially within the inner side 56 of the second handle 14. The latching member 54 also latches onto the blocking member 52 by use of a hook 55, fixing the position of the first handle 12 relative to the second handle 14.

In a preferred embodiment of the invention the first handle 12, the second handle 14, the latch 50 and the blade guard 30 are all formed from a multiple plastic material, while the transverse member 22 is formed from a metal. It is possible, however, for the individual components to be formed from a variety of materials, depending upon the particular cost, durability and quality considerations.

Figure 3:
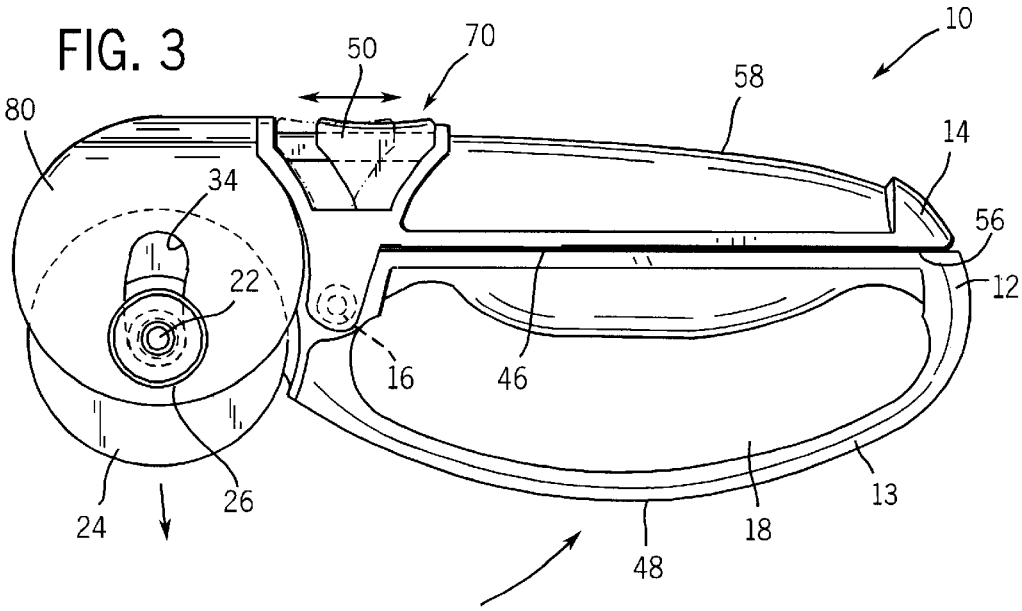
FIG. 3 is a side view of the rotary cutting device of FIG. 1 in the closed position.

As shown in FIGS. 3–4, the rotary cutting device 10 includes a front side 80 and a back side 82. In a preferred embodiment of the invention, the front side 80 includes the blade guard 30 thereon. In a most preferred embodiment of the invention, the back side 82 of the rotary cutting device 10 exposes the cutting blade 24 to a much larger degree than the front side 80 of the rotary cutting device 10. The increased exposure of the cutting blade 24 permits the user to use the rotary cutting device 10 in conjunction with an acrylic quilting ruler or straight edge (not shown). The use of such an acrylic quilting ruler, which typically has a thickness of about 0.125 inches, aids the user in cutting along a straight line.

During the operation of the rotary cutting device 10, a portion of the cutting blade 24 is completely exposed when the first handle 12 and the second handle 14 are brought towards each other. In a preferred embodiment of the invention and as shown in FIG. 3, a relatively large portion of the cutting blade 24 is exposed during cutting, aiding the user in accurately cutting the material in question.

It should be understood that the above description of the invention and specific examples and embodiments, while indicating the preferred embodiments of the present invention, are given by demonstration and not limitation. For example, it is possible that components such as the blade guard 30, the head portion 20 and the latch 50 could be placed on the other of the first handle and the second handle, depending upon the particular requirements of the customer. Additionally, a variety of different devices can be used to secure the blade 24 onto the transverse member 22. Alternatively, it may be possible to secure the blade 24 to the head portion 20 without any transverse member at all. Many changes and modifications within the scope of the present invention may therefore be made without departing from the spirit thereof and the present invention includes all such changes and modifications.

What is claimed is:

1. A hand held rotary cutter, comprising:

a first handle including a head at one end thereof for receiving a blade;

a second handle pivotally connected to the first handle and including a rotating member at one end thereof, the rotating member rotating into substantial alignment with the head of the first handle to guard the blade;

a spring for biasing the first and second handles to an open position; and a latch mounted on one of the first and second handles and movable between a unlocked position and a locked position, the latch engageable with a member on the other of the first and second handles wherein when the latch is in the locked position, the first handle and the second handle are fixed in position relative to each other.

2. The rotary cutter of claim 1, further comprising:

a transverse member coupled to the head for receiving the blade; and a cap removably connected to the transverse member, wherein the cap is capable of engaging the transverse member when the blade is received by the transverse member and when the rotating member is in alignment with the head.

3. The rotary cutter of claim 2, wherein the cap threadedly engages the transverse member.

4. The rotary cutter of claim 1, wherein the spring comprises a leaf spring, the leaf spring engaging a protrusion on one of the first and second handles.

5. The rotary cutter of claim 1, wherein the rotating member includes a slot, the transverse member passing through the slot when the rotating member is in alignment with the head.

6. The rotary cutter of claim 1, wherein the first handle includes an opening through which a user can place a hand.

7. The rotary cutter of claim 1, further comprising means for limiting the opening motion of the first and second handles.

8. The rotary cutter of claim 1, wherein the head accepts a blade having a nonuniform cutting edge.

9. A portable rotary cutter, comprising:

a first handle including a head at one end thereof for receiving a blade, the head having a transverse member upon which a blade can be mounted;

a second handle pivotally connected to the first handle and including a blade guard, the blade guard movable into and out of alignment with the head;

a biasing member for biasing the first and second handles away from each other to an open position; and a latch mounted on the second handle and movable between an unlocked position and a locked position, the latch engageable with a coupling member on the first handle.

10. The cutter of claim 9, wherein the latch is in a locked position, the first handle and the second handle are fixed in position relative to each other, and wherein when the latch is in an unlocked position, the first handle and the second handle are pivotable relative to each other.

11. The cutter of claim 10, further comprising a cap threadedly and removably coupled to the transverse member.

12. The cutter of claim 10, wherein the blade guard includes an opening for receiving the transverse member.

13. The cutter of claim 10, wherein the second handle includes an abutment for impeding the movement of the first handle.

14. The cutter of claim 10, wherein the biasing member comprises a leaf spring on the second handle, the leaf spring biasing the first handle away from the second handle.

15. The cutter of claim 10, wherein the first handle and the second handle are pivotally connected to each other by a fastener.

16. A rotary cutter, comprising:

a first handle including a post for receiving a blade;

a second handle including a blade guard movable between a first position and a second position;

means for pivotally coupling the first handle to the second handle;

a spring for biasing the first and second handles to an open position from a closed position; and means for alternately fixing the position of the first and second handles relative to each other in both the open position and the closed position.

17. The rotary cutter of claim 16, wherein the spring comprises a leaf spring.

18. The rotary cutter of claim 17, further comprising a cap removably connected to the post, wherein the cap is capable of impeding the movement of the blade guard and the blade mounted on the post.

19. The rotary cutter of claim 18, wherein the cap threadedly engages the post.

20. The rotary cutter of claim 18, wherein one of the first handle and the second handle includes an abutment for impeding the movement of the other of the first handle and the second handle.

* * * * *